US006916230B2

(12) United States Patent
Bonachera et al.

(10) Patent No.: US 6,916,230 B2
(45) Date of Patent: Jul. 12, 2005

(54) ABRASIVE BELT AND MACHINING PROCESS ASSOCIATED THEREWITH

(75) Inventors: Richard Bonachera, Vincennes (FR); Raymond Millot, Saint Yon (FR)

(73) Assignee: Societe des Procedes et Machines Speciales, Courcouronnes (FR)

( * ) Notice: Subject to any disclaimer, the term of this patent is extended or adjusted under 35 U.S.C. 154(b) by 171 days.

(21) Appl. No.: 10/358,261

(22) Filed: Feb. 5, 2003

(65) Prior Publication Data

US 2004/0029499 A1 Feb. 12, 2004

(30) Foreign Application Priority Data

Feb. 5, 2002 (FR) ..... 02 01315

(51) Int. Cl.[7] ..... B24B 1/00
(52) U.S. Cl. ..... 451/62; 451/173; 451/168
(58) Field of Search ..... 451/62, 173, 168, 451/302, 303, 307

(56) References Cited

U.S. PATENT DOCUMENTS 4,945,683 A 8/1990 Phillips
5,536,201 A 7/1996 Winkelmann
5,651,719 A * 7/1997 Pineau ..... 451/8
5,664,991 A * 9/1997 Barton, II ..... 451/65
5,707,684 A * 1/1998 Hayes et al. ..... 427/162
5,762,542 A 6/1998 Sandvold
6,102,783 A * 8/2000 Loock et al. ..... 451/173
6,520,883 B1 * 2/2003 Rennerfelt ..... 475/163

* cited by examiner

*Primary Examiner*—Joseph J. Hail, III
*Assistant Examiner*—Alvin J Grant
(74) *Attorney, Agent, or Firm*—Young & Thompson

(57) ABSTRACT

A process and device for machining by abrasive belt, on a part 1 with an axis of rotation, of a non-cylindrical bearing surface 2, two portions of the same running abrasive belt 14, which are spaced apart from each other in the longitudinal direction of the belt, using two independent support components 12, preferably activated by two jacks 8 mounted on a common carrier 4, along two contact zones spaced apart angularly around the axis of rotation of the part, are applied against the bearing surface 2. The application is particularly suited for cam surfaces of cam shafts.

9 Claims, 12 Drawing Sheets

ABRASIVE BELT AND MACHINING PROCESS ASSOCIATED THEREWITH

BACKGROUND OF THE INVENTION

The present invention relates to a process and a device for the machining by abrasive belt, on a part with an axis of rotation, of at least one non-cylindrical bearing surface, particularly for superfinishing a cam surface on a cam shaft.

DESCRIPTION OF THE RELATED ART

Superfinishing by abrasive belt, commonly called superfinishing by "polishing", of cam surfaces on camshafts may be carried out, with the camshaft mounted between centres and driven in rotation around an axis, by applying a running abrasive belt against a cam surface using a support roller pushed against said cam surface by a jack. The same abrasive belt portion is however then sometimes applied, in the cam apex zone, twice in succession against the same surface, i.e., first of all in a new state against a first cam side and then in a "worn" state against a second side of the same cam, which does not make it possible to give to the cam surface a very precise machining quality (surface condition) at all points of the circumference.

In another respect, machining a cam surface by applying a single abrasive belt using a single support roller against this cam surface entails a relatively long machining time.

Applying several abrasive belts using several support rollers against the same cam surface would consequently allow the time taken in machining the cam surface to be reduced, but the result would be to increase the cost—several support units, several abrasive belts, several running (unwinding/winding) abrasive belt systems.

A proposal has also already been made (see for example U.S. Pat. No. 4,993,191) for a cam surface to be machined by means of the same abrasive belt using a clamp type tool including two opposing jaws which grip the cam surface between them, each jaw bearing a pad with angular mobility with two support rollers spaced apart, allowing the four clamp rollers to "follow" the came profile. However, this tool and the machine to which it is fitted have a complex structure and a high cost. In addition, it again has the drawback with respect to inconsistent machining qualities particularly of the two sides of a cam in the cam apex zone. Furthermore, because of the effect of clamping the cam between the two jaws, this tool does not by definition allow any adjustment of the support pressure exerted by each support roller, which would in certain circumstances be desirable. Finally, with this tool with four support rollers, only the first roller reached by the abrasive belt applies new abrasive belt against the cam surface, while the other three rollers apply increasingly worn abrasive belt, which reduces their machining effectiveness.

SUMMARY OF THE INVENTION

The present invention targets an abrasive belt machining process enabling improvements in the speed, quality and consistency of machining of non-cylindrical bearing surfaces and particularly cam surfaces. The invention further targets an abrasive belt machining process enabling the abrasive belt support pressures to be adjusted on demand. The invention also targets a device for machining by abrasive belt, which has a simple structure and enables non-cylindrical bearing surfaces to be machined at reduced cost at high speed and with a high degree of machining quality and consistency.

The process comprising the subject of the invention is intended for the machining by abrasive belt, on a part with an axis of rotation, of a non-cylindrical bearing surface, particularly a cam surface of a camshaft. This process includes a machining cycle consisting in applying an abrasive belt, using support means along an approximately linear contact zone, parallel to the axis of rotation of the part, against the bearing surface while the part is driven in rotation around its axis of rotation, and in running the abrasive belt in its longitudinal direction on the support means during machining. According to the invention, two portions of the same running belt, spaced apart from each other in the longitudinal direction of the belt, using two independent support components, along two contact zones angularly spaced apart around the axis of rotation of the part, are applied against the bearing surface.

Preferably, the two abrasive belt portions are applied using the two support components against the bearing surface along two directions of effect, which intersect on the axis of rotation of the parts.

In this case, the two abrasive belt portions may be applied along two directions of effect making relative to each other an angle of less than 180°, to advantage along two directions of effect making relative to each other an angle of less than 120° and preferably less than or equal to 90°.

It is possible to pass the abrasive belt directly from one support component to the other, by pulling the belt over the bearing surface between the two support components. The second support component thus always applies "worn" abrasive belt against the bearing surface, i.e., belt that has already been used at the level of the first support component.

However, according to one embodiment, to make it possible to obtain the same machining efficiency at the level of each of the two support components, and to make optimum use of the single abrasive belt, it is possible to advance the abrasive belt, between two successive machining cycles, by a length corresponding approximately to the belt run length during each machining cycle, and to deflect the abrasive belt between the two support components in the form of a loop of a length such that at each machining cycle, the second support component receives and applies equally a new abrasive belt portion against the bearing surface.

The device forming the subject of the invention and used to implement the above process includes means for carrying the part and for driving it in rotation around its axis, support means for applying at least one abrasive belt against at least one bearing surface of the part, and means for guiding and driving the abrasive belt so as to make the abrasive belt run in its longitudinal direction over the support means. According to the invention the support means include two support units mounted on a common carrier and each having a support component mobile perpendicular to the axis of rotation of the part independently of that of the other support unit. The guidance and drive means are designed to run the same abrasive belt successively over the two support components.

In the context of the invention, the two support units may for example each include a spring or another uncontrolled means allowing a support force to be exerted on the associated support component. In this case, the common carrier must preferably be mobile transversally relative to the part before and after each machining cycle.

However, according to a preferred embodiment, the two support units each include a fluid jack, the cylinders of the two jacks being mounted on the same carrier in such a way that the axes of the piston rods bearing the support components intersect on the axis of rotation of the part. In this case, the common carrier may be stationary, the jack control alone then making it also possible to obtain the necessary displacements of the support components relative to the bearing surface before and after each machining cycle. Moreover, the jacks enable the support force to be defined with accuracy and particularly kept consistent over the whole circumference of the bearing surface, which is not the case when using springs or similar means.

The two jacks can be controlled separately, which allows the abrasive belt support force and time spent against the bearing surface by each support component to be adjusted on demand.

The carrier may additionally carry a belt idler on which the abrasive belt is deflected by being guided transversally between the two support rollers. This allows the abrasive belt which is not guided transversally to its length at the level of the two support rollers to follow better the flapping movements along the axis of the part, movements which are indispensable in superfinishing, as is well known per se.

BRIEF DESCRIPTION OF THE DRAWINGS

With reference to the appended diagrams, two illustrative and non-restrictive embodiments of a device according to the invention will now be described in more detail; in the drawings.

DESCRIPTION OF THE PREFERRED EMBODIMENT

Figure 1:
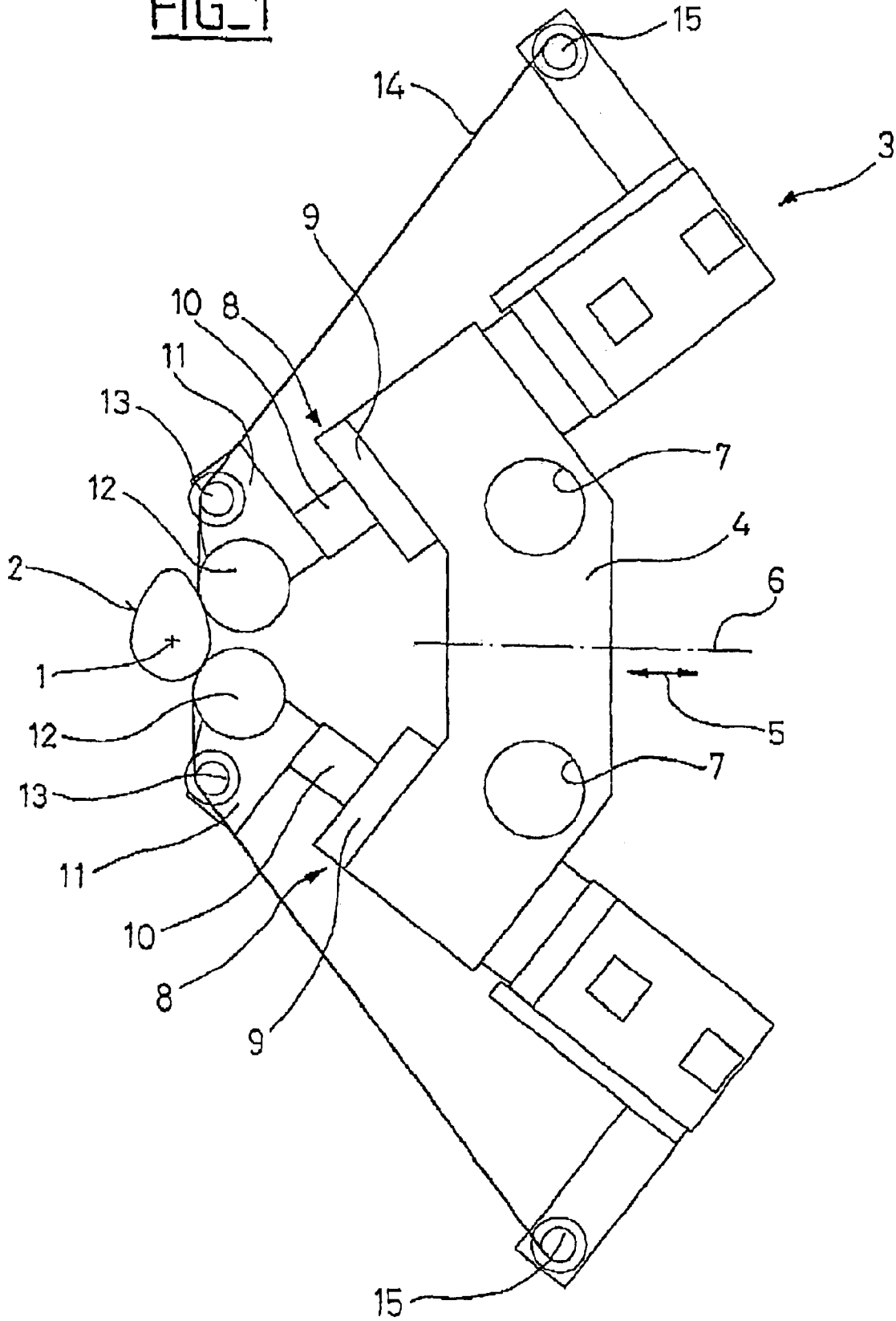
FIGS. 1 to 6 show a device according to a first embodiment in several successive positions during the rotation of a camshaft.
Figure 2:
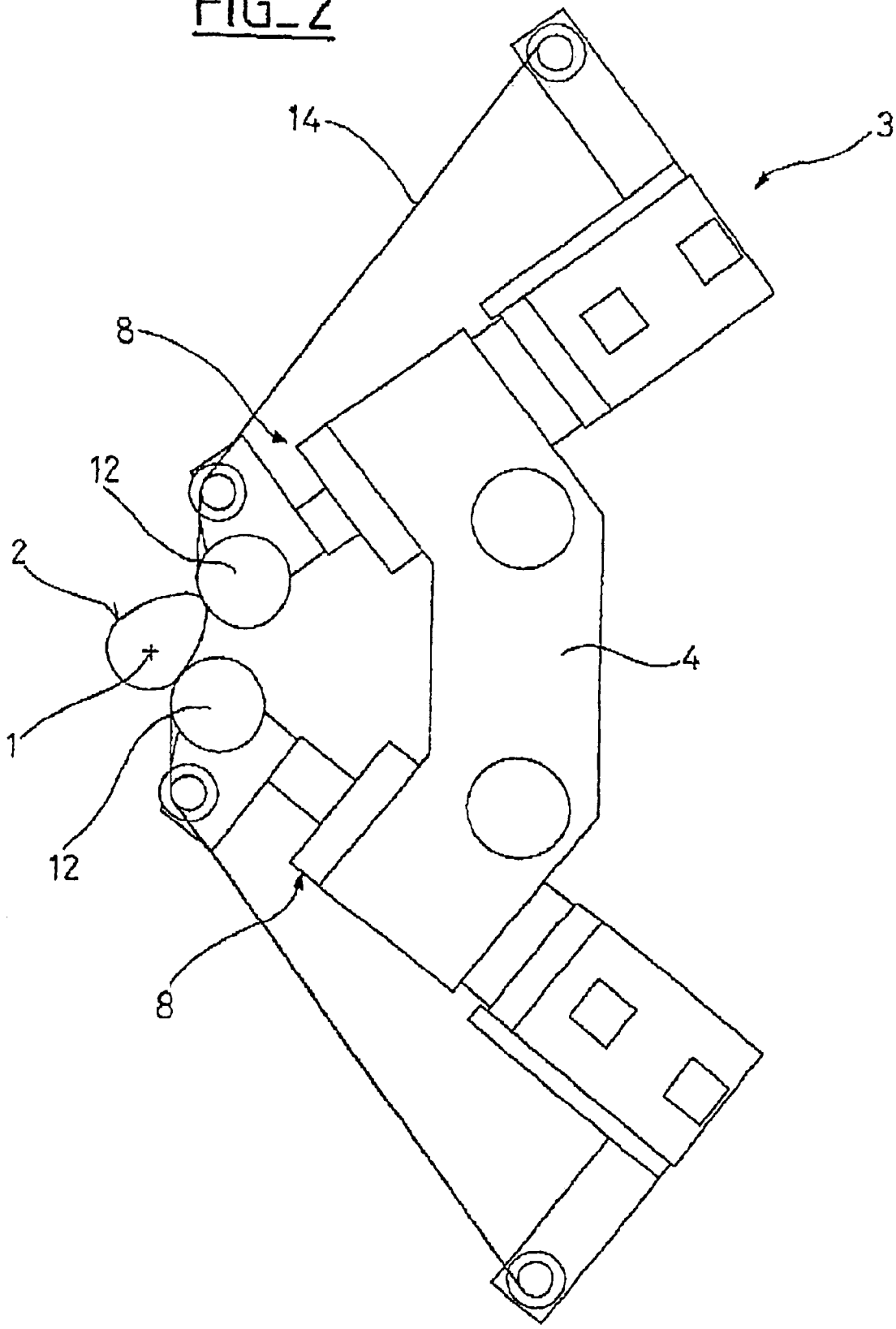
Figure 3:
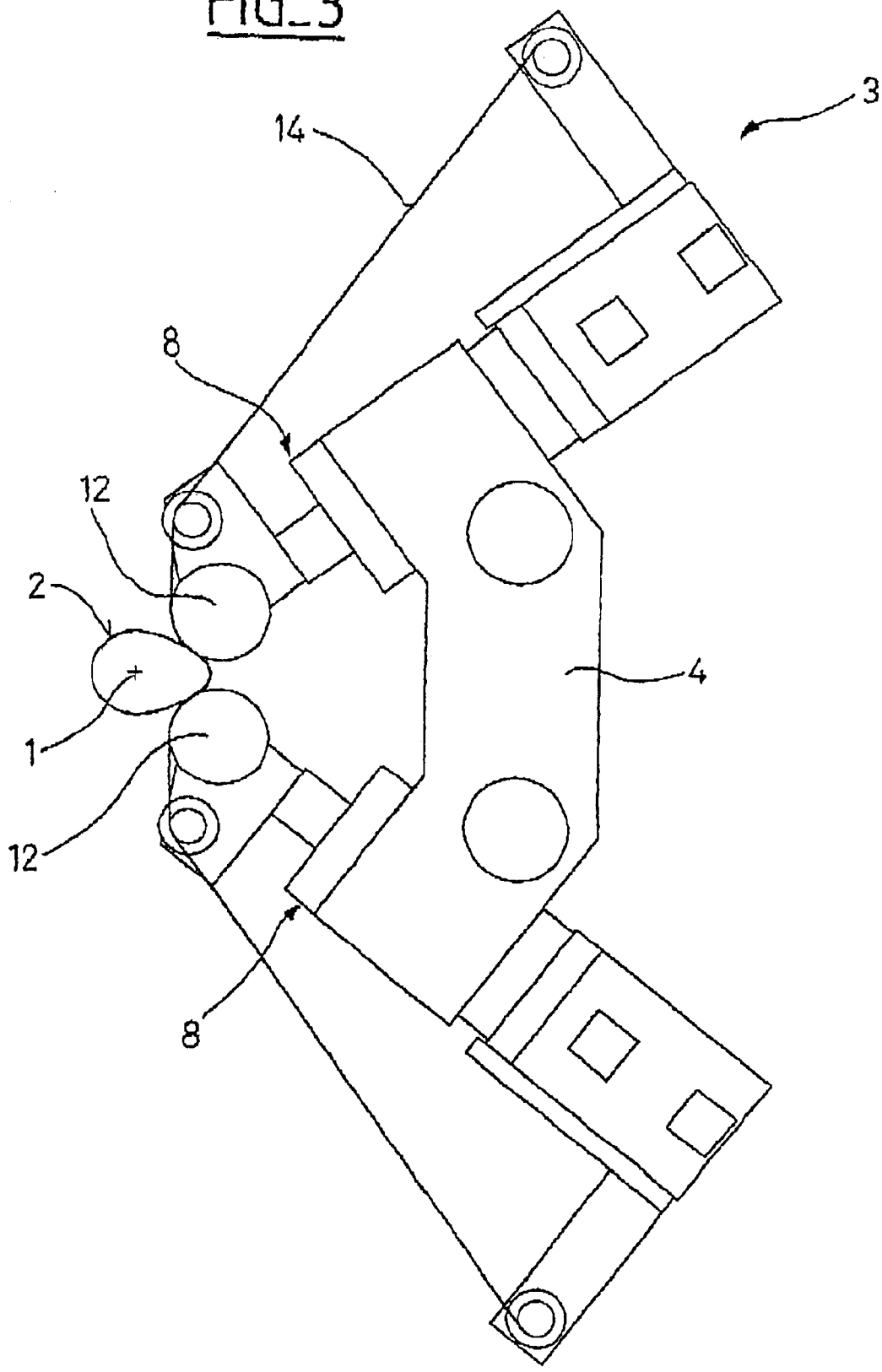
Figure 4:
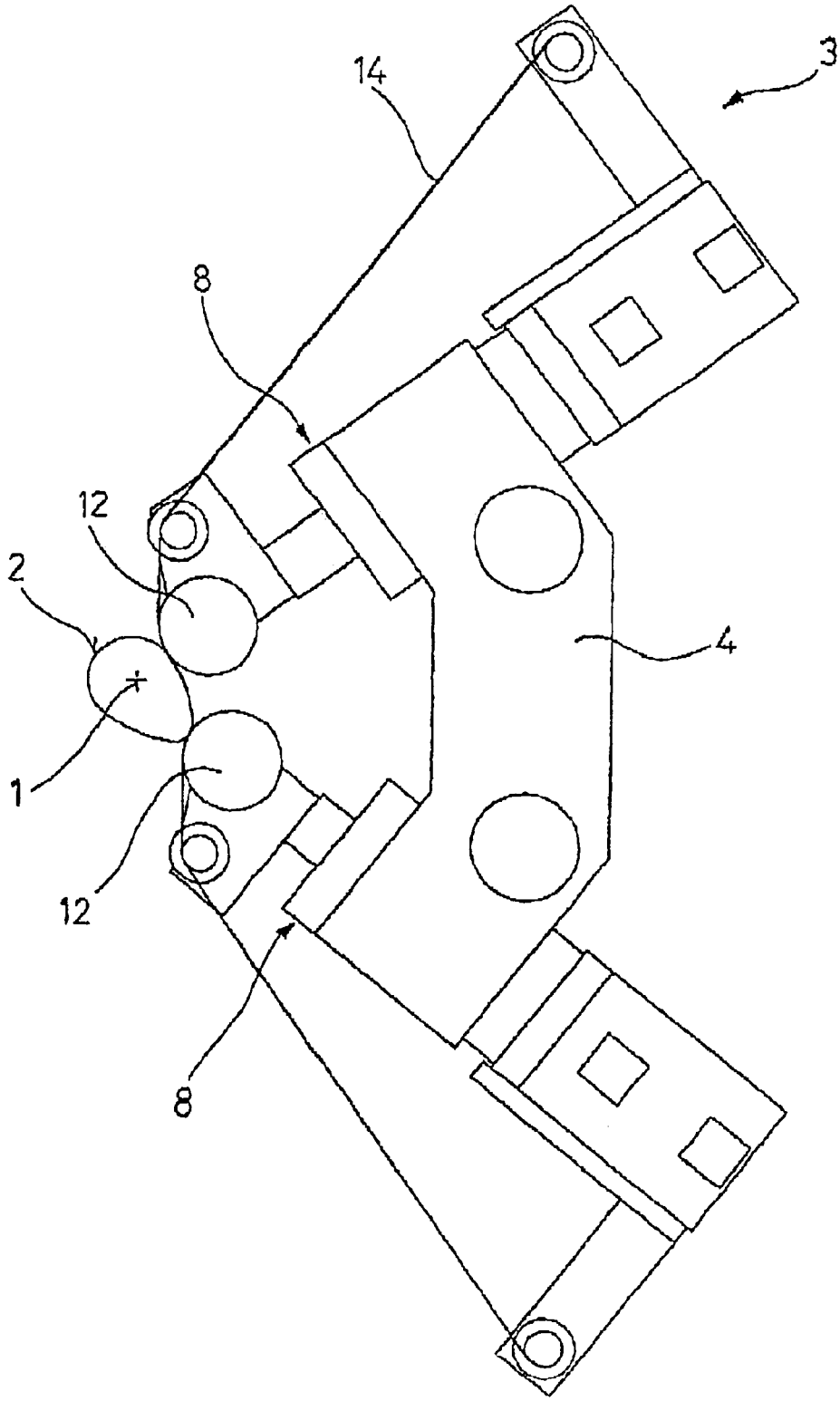
Figure 5:
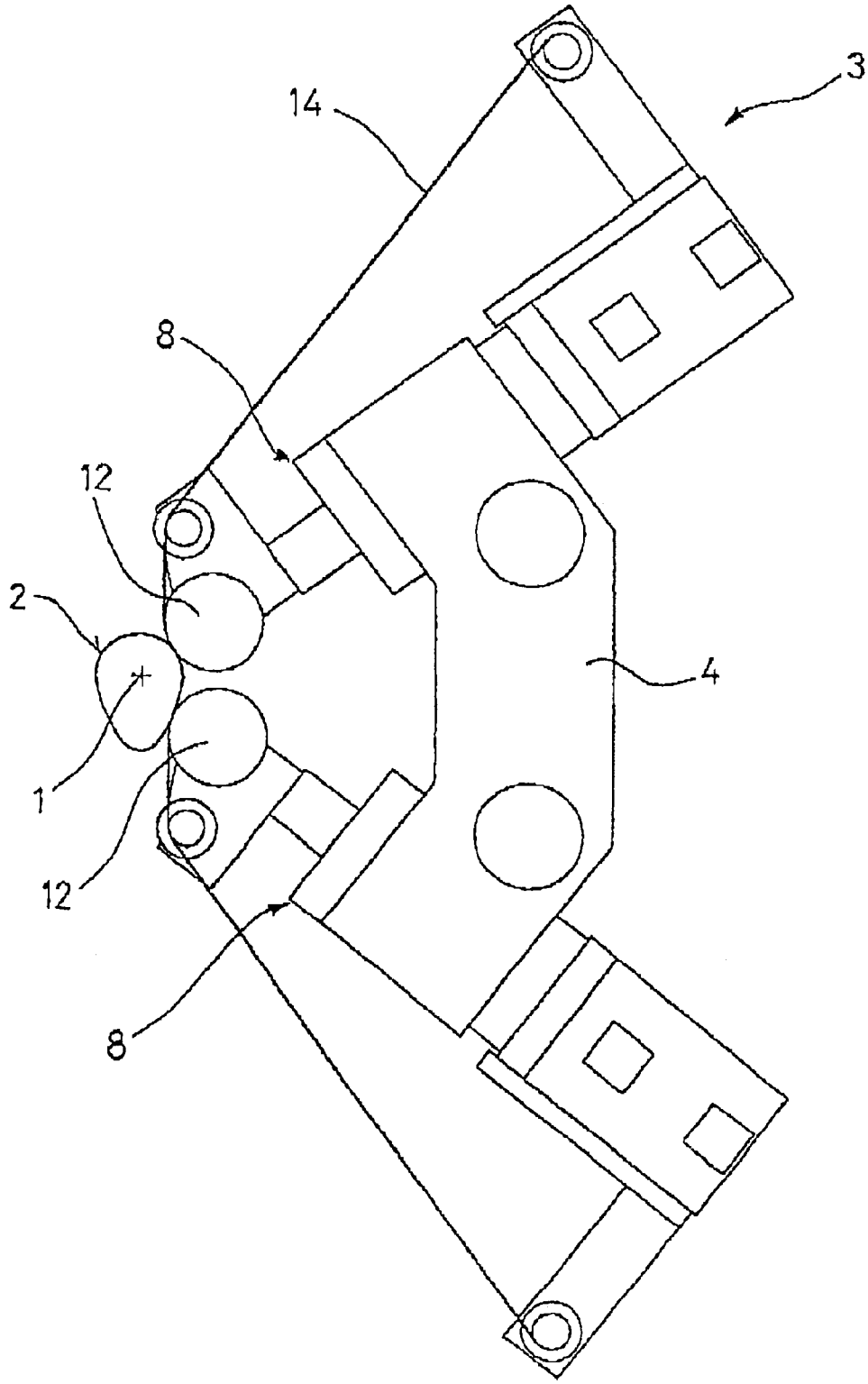
Figure 6:
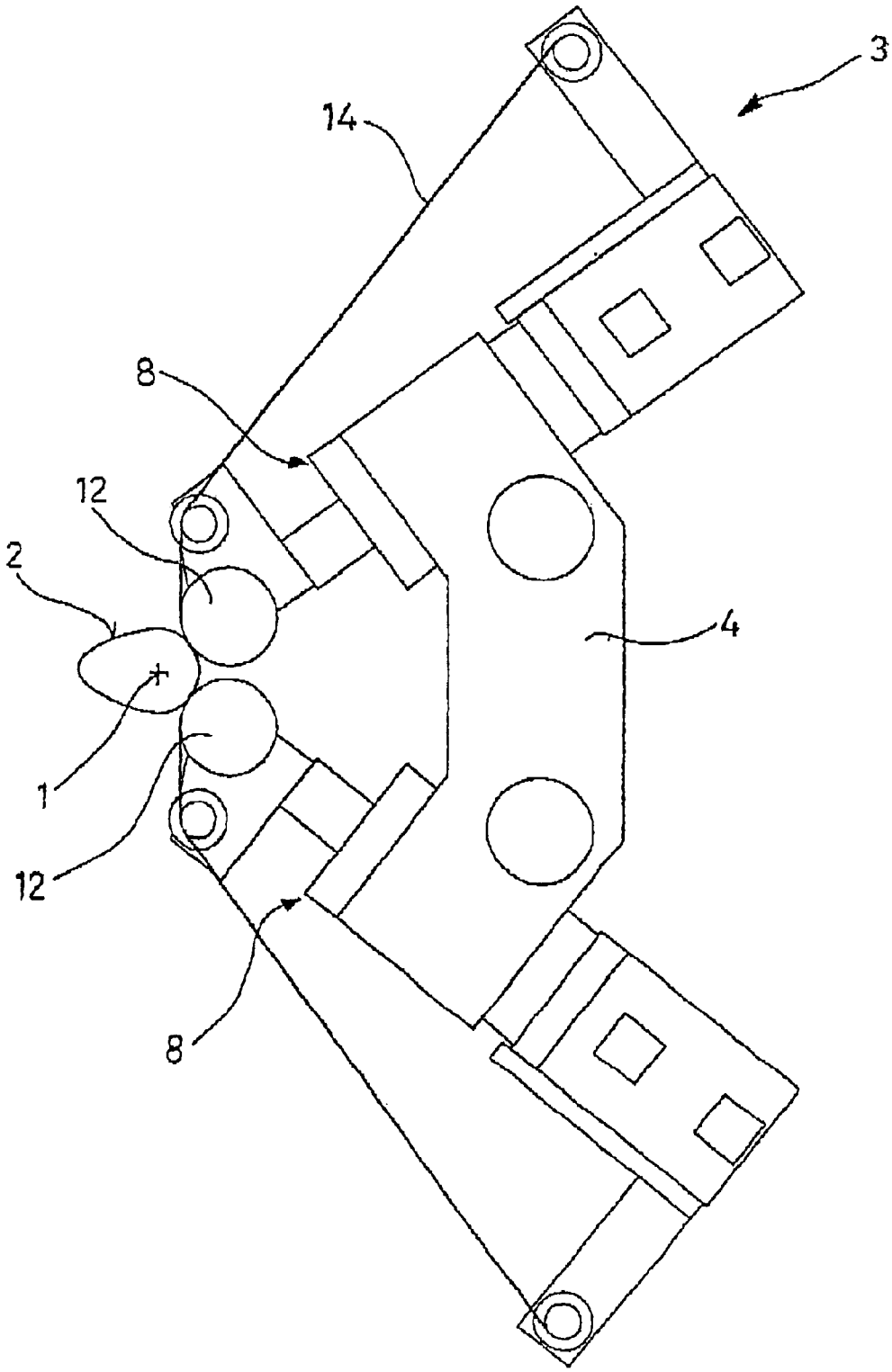
Figure 7:
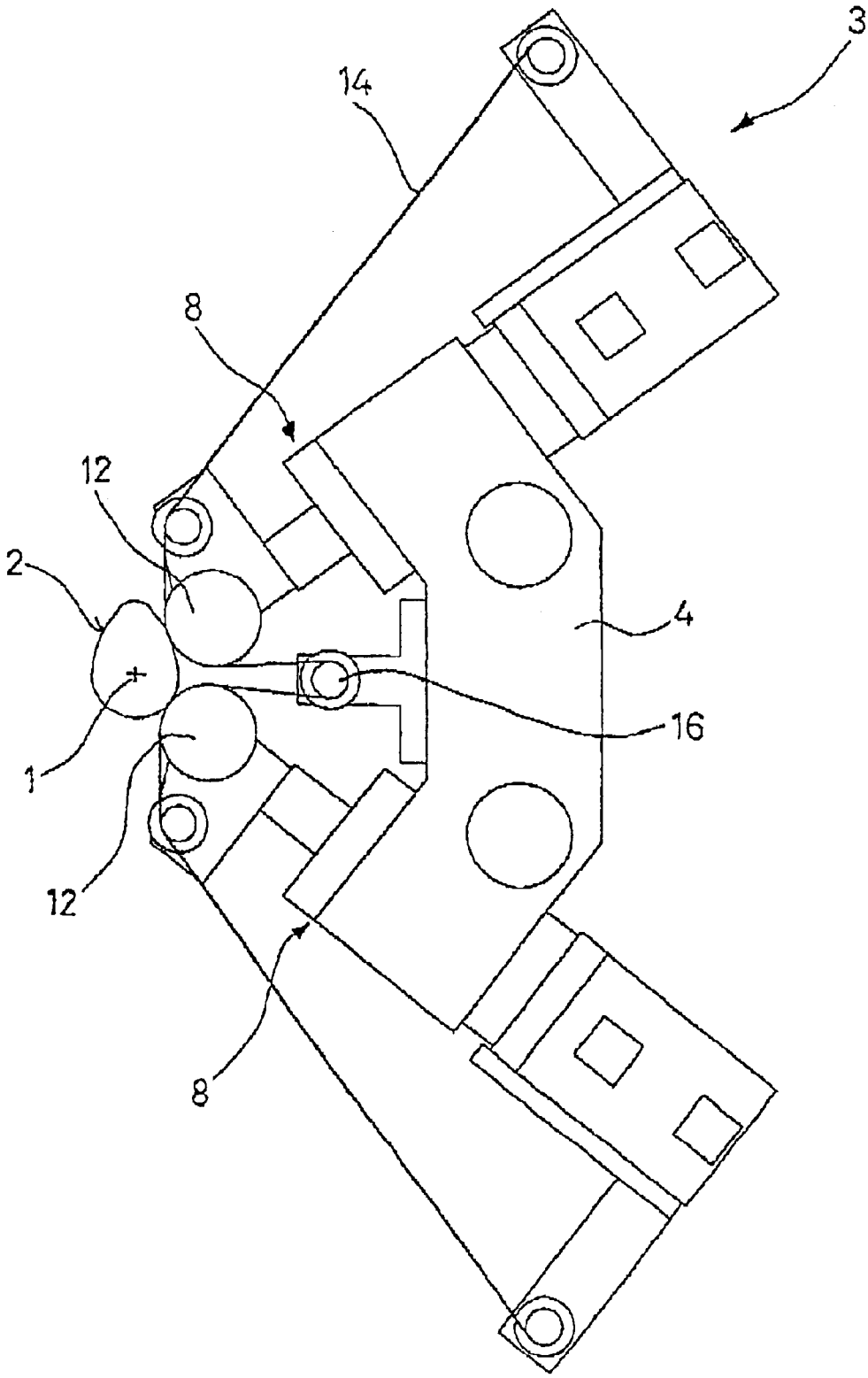
FIGS. 7 to 12 show a device according to a second embodiment in the same successive positions.
Figure 8:
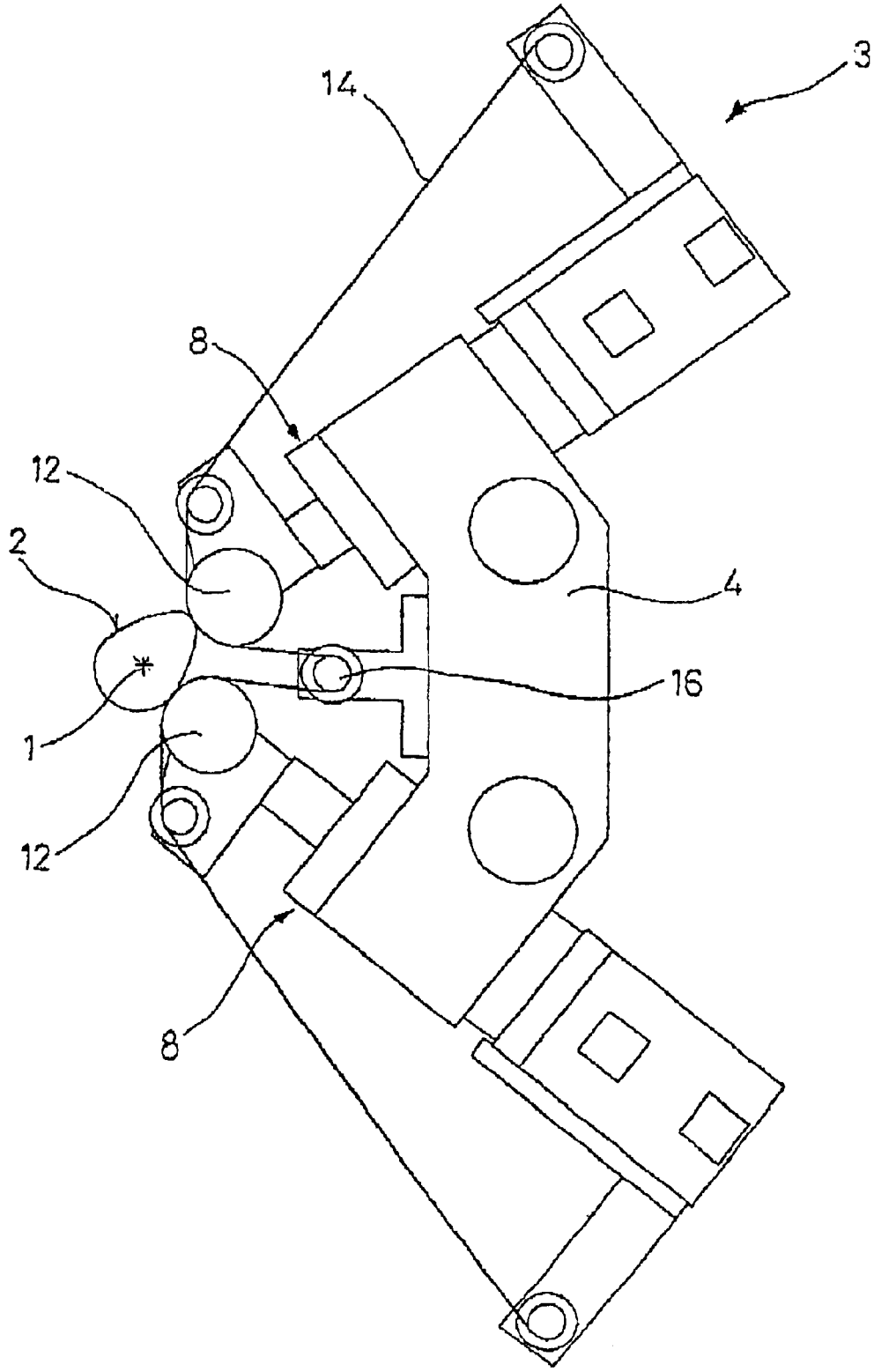
Figure 9:
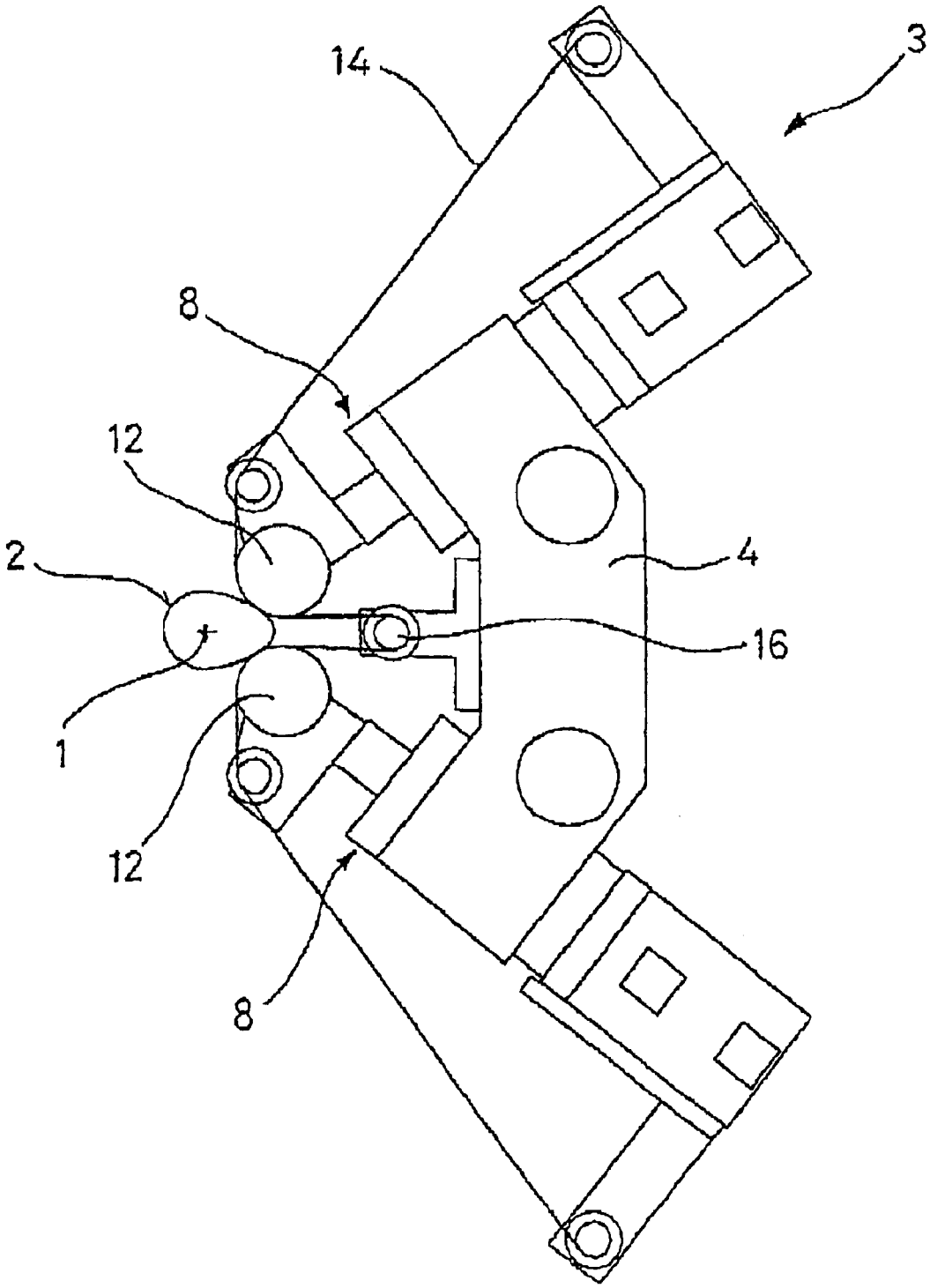
Figure 10:
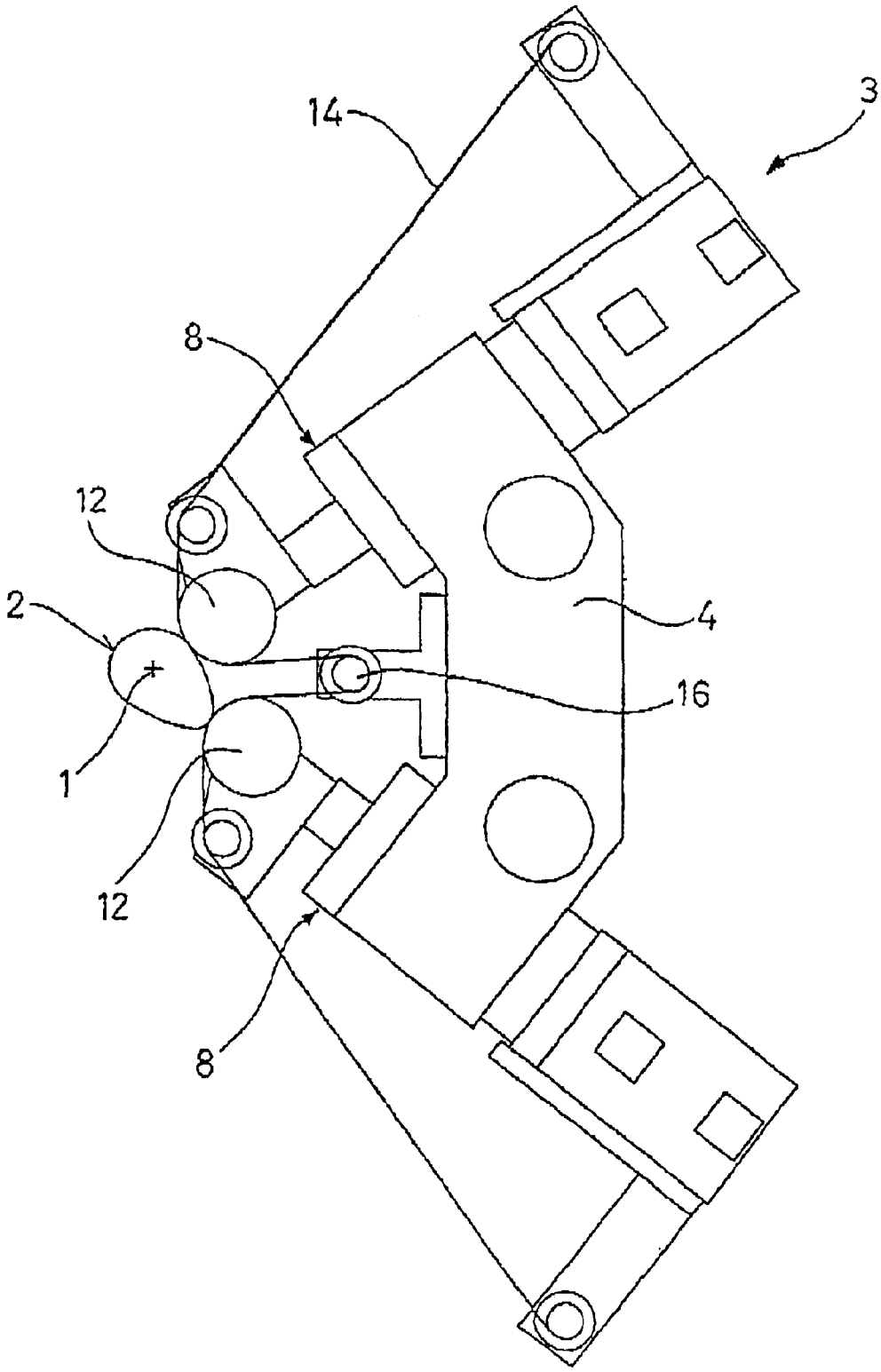
Figure 11:
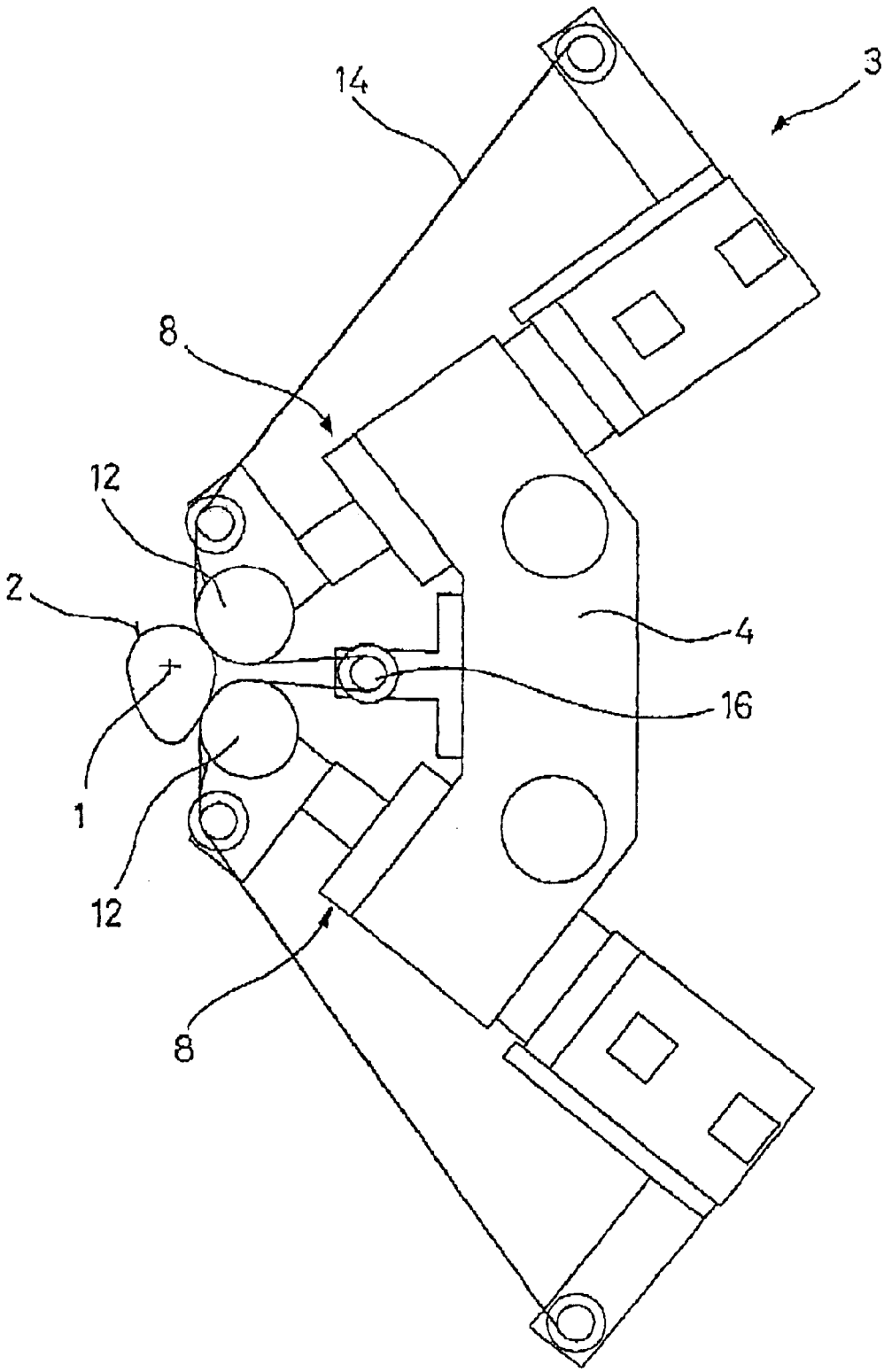
Figure 12:
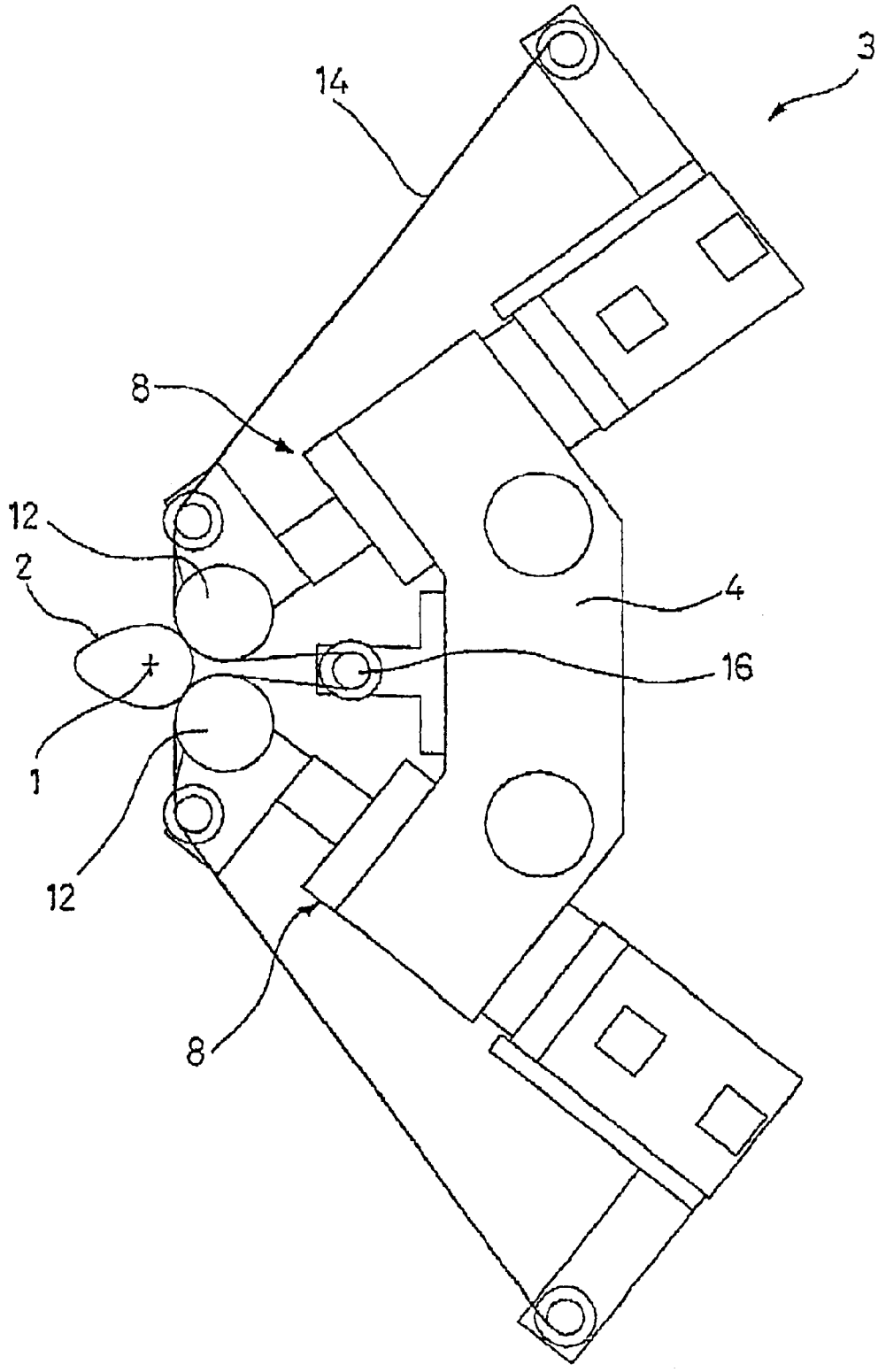

According to FIG. 1, a camshaft 1 symbolised by its axis of rotation is mounted between centres and driven in rotation around its axis which is here horizontal for the purpose of machining (superfinishing) a cam surface 2 using a device 3 placed on one side of the camshaft 1, approximately in the plane of the cam (surface) 2 to be machined.

The device 3 includes a carrier 4 mounted, by means not shown, in a position adjustable way (arrow 5) relative to the camshaft 1, along a direction perpendicular to the axis of the latter. For the particular purpose of adapting to different camshafts, the carrier 4 which is symmetrical relative to a plane 6 passing through the axis of the camshaft 1 may furthermore be position adjustable parallel to the axis of the camshaft 1 by guide means which can for example be sockets 7 mobile on sliders.

The carrier 4 carries, in the same plane perpendicular to its plane of symmetry 6, in symmetrical positions relative to this plane 6, two fluid jacks 8, for example dual effect air jacks, the cylinders 9 of which are integral with the carrier 4 in such a way that the axes of the piston rods 10 intersect on the axis of rotation of the camshaft 1. Each piston rod 10 carries at its free end a mount 11 on which are mounted in the same plane a support roller 12 and a guidance roller 13 being mobile in rotation around axes parallel to the axis of the camshaft 1. The support rollers 12 are in the extension of the piston rods 10 and the guidance rollers 13 are offset one upwards and one downwards relative to the support rollers 12, respectively. An abrasive belt 14 passes from one new belt spool not shown via a first belt idler 15 over a first guidance roller 13, then successively over the two support rollers 12 which apply it against the cam surface 2, to return via the second guidance roller 13 over a second belt idler 15 and from there to a worn belt rewinding spool not shown. A controlled drive means system not shown, makes it possible to advance, therefore to run the abrasive belt 14 on demand.

The two support rollers 12, under the effect of the two jacks 8, thus apply the same abrasive belt 14 against the camshaft surface 2 along two approximately linear contact zones, parallel to the axis of the camshaft 1 and angularly spaced apart around this axis, while the camshaft 1 is driven in rotation around its axis and the abrasive belt 14 is driven in its longitudinal direction to run over the support rollers 12.

As it appears in FIGS. 1 to 6, the jacks 8 controlling the support rollers 12 make it possible to apply the abrasive belt 14, in each of the two contact zones defined by the two rollers 12, permanently against the cam surface 2 with a force which is solely a function of the fluid inlet pressure of each jack. This support force does not therefore vary with the radial distance of the support rollers 12 relative to the axis of rotation, which, when a cam surface on a camshaft is machined, varies during the rotation of the camshaft around its axis.

It may furthermore be desirable in some cases to apply the abrasive belt 14 against the cam surface 2 with different pressures and/or for different lengths of time via the two support rollers 12 during each machining cycle. This result may be obtained in a simple way on the device as shown and described by a corresponding individual control of the fluid inlet of each of the two jacks 8.

The device 3 as illustrated in FIGS. 7 to 12 repeats all the general structure characteristics of the device 3 according to FIGS. 1 to 6, but additionally comprises, on the carrier 4, between the two jacks 8, a belt idler and guidance roller 16 over which the abrasive belt 14 passes between the two support rollers 12, by being deflected and guided transversally. The abrasive belt 14 which is not guided laterally over the support rollers 12 which lack guidance flanges thus participates better in the flapping movements imparted to the whole machining device 3, as is usual in superfinishing, transversally to the length of the abrasive belt 14, therefore, parallel to the axis of the camshaft 1.

The belt idler 16 imposes on the belt 14, between the two support rollers 12, an additional path in the form of a loop, of a preferably adjustable length, this being a function of the position or distance of the roller 16 relative to the support rollers 12.

It is possible, according to one embodiment, to advance the abrasive belt 14, between two successive machining cycles relating to two cam surfaces which are either on the same camshaft, or on two different camshafts, by a length corresponding approximately to the belt run length during each machining cycle, and to adjust the length of the abrasive belt deflection loop via the belt idler 16 in such a way that it corresponds to this abrasive belt run length during each machining cycle. In this way, at each machining cycle, the second support roller receives and applies against the cam surface, just like the first support roller, a new abrasive belt portion, rather than a "worn" abrasive belt portion which has already being used at the level of the first support roller, as is the case for the embodiment in FIGS. 1 to 6 where the abrasive belt 14 "drags" over the cam surface 2 between the two support rollers 12.

In both illustrated embodiments, the two jacks 8 are mounted on the carrier 4 in such a way that the axes of their piston rods 10 which intersect on the axis of rotation of the camshaft 1 make relative to each other an angle which is slightly less than 90°. This angle may however be different, inasmuch as it remains below 180°.

Furthermore, the two jacks 8 could be replaced by other means producing the support pressures of the rollers 12 against the cam surface 2, for example by springs, but the essential advantage of the jacks 8 is that they can be controlled on demand, which makes it possible, for example, to adjust the support pressures and the support times of the two rollers 12 and to move the two rollers 12 before and after each machining cycle using just the support jacks 8 in order to engage the abrasive belt 14 with and to disengage it from the cam surface 2, without moving the carrier 4 closer to or further away from the camshaft 1 following the arrow 5 which can be seen in FIG. 1.

Finally, although the invention has been described above in its application to superfinishing the cam surfaces of camshafts, it may be applied to the machining by abrasive belt of other surfaces and particularly non-cylindrical bearing surfaces on other parts that have an axis of rotation.

In all cases, the invention makes it possible to obtain, with a single abrasive belt and a single system for supporting and running this abrasive belt, a machining result equivalent to that obtained by two abrasive belts and two systems for supporting and running these two belts.

What is claimed is:

1. Process for the machining by abrasive belt, on a part with an axis of rotation, of a non-cylindrical bearing surface, particularly a cam surface on a camshaft, comprising a machining cycle applying an abrasive belt, using support means along an approximately linear contact zone, parallel to the axis of rotation of the part, against the bearing surface while the part is driven in rotation around its axis of rotation, and running the abrasive belt in its longitudinal direction on the support means during machining, two portions of the same running belt, spaced apart from each other in the longitudinal direction of the belt, using two independent support components, along two contact zones angularly spaced apart around the axis of rotation of the part, being applied against the bearing surface, wherein, the abrasive belt is advanced, between two successive machining cycles, by a length corresponding approximately to the belt run length during each machining cycle, the abrasive belt is deflected between the two support components in the form of a loop distant from the part, and the abrasive belt has a length such that at each machining cycle, the second support component receives and applies a new abrasive belt portion against the bearing surface.

2. Process according to claim 1, characterised in that the two abrasive belt portions are applied using the two support components against the bearing surface along two directions of effect, which intersect on the axis of rotation of the part.

3. Process according to claim 2, characterised in that the two abrasive belt portions are applied along two directions of effect which make relative to each other an angle of less than 180.

4. Process according to claim 3, characterised in that both abrasive belt portions are applied along two directions of effect which make relative to each other an angle of less than 120.

5. Process according to claim 3, characterised in that both abrasive belt portions are applied along two directions of effect which make relative to each other an angle of less than or equal to 90.

6. Device for the machining by abrasive belt, on a part with an axis of rotation, of a non-cylindrical bearing surface, particularly a cam surface on a camshaft, comprising:

means for carrying the part and for driving it in rotation around its axis, support means for applying at least one abrasive belt against at least one bearing surface of the part, and abrasive belt guidance and drive means to run the abrasive belt in its longitudinal direction over the support means, the support means including two support units (8) mounted on a common carrier (4) and each having a support roller (12) mobile perpendicular to the axis of rotation of the part (1) independently of that of the other support unit, and the guidance and drive means (13, 15) designed to run the same abrasive belt (14) successively over the two support components (12), the carrier (4) carrying a belt idler (16) on which a portion of the abrasive belt (14) is deflected by being guided transversally between the two support rollers (12), said portion being distant from the surfaces of the support rollers in contact with the part.

7. Device according to claim 6, characterised in that the two support units each include a fluid jack (8), the cylinders (9) of the two jacks being mounted on the carrier (4) in such a way that the axes of the piston rods (10) each bearing a support roller (12) intersect on the axis of rotation of the part (1).

8. Device according to claim 7, characterised in that the two jacks are controlled separately.

9. Device for the machining by abrasive belt, on a part with an axis of rotation, of a non-cylindrical bearing surface, including a cam surface on a camshaft, comprising:

means for carrying the part and for driving the part in rotation around the part's axis; and support means for applying at least one abrasive belt against at least one bearing surface of the part; and abrasive belt guidance and drive means for run the abrasive belt in the belt's longitudinal direction over the support means, the support means including two support units (8) mounted on a common carrier (4), each support unit having a support roller (12) mobile perpendicular to the part's axis of rotation independently of the support roller of the other support unit, the guidance and drive means (13, 15) designed to run the same abrasive belt (14) successively over the two support components (12), and the carrier carrying a belt idler (16), radially opposed to the part towards the support rollers (12), on which a portion of the abrasive belt (14) is deflected by being guided transversally between the two support rollers (12).

* * * * *